United States Patent [19]

Frenier et al.

[11] 4,220,550

[45] Sep. 2, 1980

[54] COMPOSITION AND METHOD FOR REMOVING SULFIDE-CONTAINING SCALE FROM METAL SURFACES

[75] Inventors: Wayne W. Frenier, Tulsa; Michael D. Coffey, Jenks; James D. Huffines, Bixby, all of Okla.; Donald C. Smith, Midland, Mich.

[73] Assignee: The Dow Chemical Company, Midland, Mich.

[21] Appl. No.: 967,047

[22] Filed: Dec. 6, 1978

[51] Int. Cl.[2] ..... C02B 5/06; C02B 1/18

[52] U.S. Cl. ..... 252/180; 252/148; 252/181; 252/86; 252/87; 252/8.55 E; 134/40; 134/41; 422/12

[58] Field of Search ..... 252/148, 180, 181, 86, 252/87, 8.55 E; 134/40, 41; 422/12

[56] References Cited

U.S. PATENT DOCUMENTS

| | | | |
|---|---|---|---|
| 2,606,873 | 8/1952 | Cardwell et al. | 252/148 |
| 2,965,577 | 12/1960 | Bialik et al. | 252/148 |
| 3,077,454 | 2/1963 | Monroe et al. | 252/148 |
| 3,335,090 | 8/1967 | Dauldowitch et al. | 252/148 |
| 3,514,410 | 5/1970 | Engle et al. | 252/87 |
| 3,669,613 | 6/1972 | Knox et al. | 252/148 |

*Primary Examiner*—Mayer Weinblatt

*Attorney, Agent, or Firm*—L. Wayne White

[57] ABSTRACT

Sulfide-containing scale is removed from metal surfaces by contacting the encrusted surface with an aqueous acid cleaning solution having an aldehyde (e.g., formaldehyde) dissolved or dispersed in the acid in an amount sufficient to prevent the evolution of hydrogen sulfide gas.

21 Claims, No Drawings

COMPOSITION AND METHOD FOR REMOVING SULFIDE-CONTAINING SCALE FROM METAL SURFACES

BACKGROUND OF THE INVENTION

1. Field of the Invention

This invention pertains to a method of chemically cleaning sulfide-containing scale from metal surfaces. The novel process utilizes aqueous acid cleaning solutions containing an aldehyde in amounts sufficient to prevent or substantially prevent the evolution of hydrogen sulfide gas.

2. Description of the Prior Art

Many sources of crude oil and natural gas contain high amounts of hydrogen sulfide. Refineries processing such crude oil or natural gas commonly end up with substantial amounts of sulfide-containing scale on the metal surfaces in contact with the crude oil or gas. This scale is detrimental to the efficient operation of heat exchangers, cooling towers, reaction vessels, transmission pipelines, furnaces, etc. Removal of this sulfide-containing scale has been a substantial problem because conventional acid-cleaning solutions react with the scale and produce gaseous hydrogen sulfide.

Hydrogen sulfide gas produced during the cleaning operation leads to several problems. First, hydrogen sulfide is an extremely toxic gas and previous techniques have required the entire system to be vented to an appropriate flare system (in which the gas is burned) or to a sodium hydroxide scrubbing system. Neither of these alternatives is very attractive because the sulfur dioxide and sulfur trioxide formed during the burning of hydrogen sulfide are substantial pollutants in and of themselves. The sodium sulfide produced during the scrubbing system is a solid that presents disposal problems. It can be land-filled or put into disposal ponds but only under conditions such that the sodium sulfide does not contact acid. Sodium sulfide reacts rapidly with acids to regenerate hydrogen sulfide. Second, aside from the toxic nature of hydrogen sulfide, the material causes operational problems as well because it is a gas. The volume of gas produced can be substantial. The gas takes up space within the unit being cleaned and can prevent the liquid cleaning solution from coming in contact with all of the metal surfaces. This can occur, for example, in cleaning a horizontal pipeline where the gas can form a "pad" over the top of the flowing liquid and prevent the liquid from filling the pipeline and cleaning the entire surface. The gas produced can also cause the pumps used in the system to cavitate, lose prime, and/or cease to function efficiently. And, of course, if enough gas is generated in a confined vessel the vessel can rupture.

These problems have been encountered in the industry and are severe.

Hydrogen sulfide and acid cleaning solutions containing hydrogen sulfide can cause severe corrosion problems on ferrous metals. The corrosion can be due to attack by ion and/or ferric acid corrosion. These corrosion problems have been met in the past by including minor amounts of corrosion inhibitors in the system. Aldehyde and aldehyde condensation products (normally with an amine) have been used as corrosion inhibitors in various systems. For example, they have been used alone or in combination with other corrosion inhibitors in aqueous acidic cleaning solutions and pickling baths or as an additive to crude oil. Under these systems, however, the aldehyde was included in very minor amounts. The following patents are representative of how these aldehydes have been previously used in this regard: U.S. Pat. Nos. 2,426,318; 2,606,873; 3,077,454; 3,514,410; and 3,669,613.

The reaction of hydrogen sulfide with an aldehyde is a known reaction which has been the subject of some academic interest. See, for example, the journal articles abstracted by Chemical Abstracts in C.A.54:17014h; C.A.63:14690a; C.A.65:9026d. The references indicate that the product formed by hydrogen sulfide with formaldehyde is trithiane or low polymers. This product was also referred to in U.S. Pat. No. 3,669,613 cited above. In these references, the product was produced by bubbling hydrogen sulfide through the aqueous acid/formaldehyde systems and the patent indicates that the reaction should not be attempted at temperatures greater than about 45° C. The patent also indicates that the reaction usually reaches completion in from about 5½ hours to about 9½ hours at ambient temperatures.

None of these references teach or suggest the unique phenomenon that we have observed and is the basis for our invention set forth below.

SUMMARY OF THE INVENTION

We have discovered a new and improved method for chemically cleaning sulfide-containing scale from metal surfaces which avoids safety and pollution problems that were presented by prior art processes. Our novel process comprises contacting the sulfide-containing scale with an aqueous acid cleaning solution containing at least one aldehyde dissolved or dispersed therein in an amount at least sufficient to prevent or substantially prevent the evolution of hydrogen sulfide gas.

We were surprised to discover that the hydrogen sulfide produced during the cleaning process is taken up or consumed substantially as it is formed. The reaction appears to be essentially instantaneous and essentially quantitative. Very little or no hydrogen sulfide gas is evolved during the cleaning process.

DETAILED DESCRIPTION OF THE INVENTION

The aqueous acid cleaning solutions are well known. Normally, these acid cleaning solutions are aqueous solutions of nonoxidizing inorganic and/or organic acids and more typically are aqueous solutions of hydrochloric acid or sulfuric acid. Examples of suitable acids include, for example, hydrochloric, sulfuric, phosphoric, formic, glycolic, citric, and the like. In this invention, we prefer aqueous solutions of hydrochloric acid or sulfuric acid, and most prefer aqueous solutions of sulfuric acid. The acid strength can be varied as desired, but normally acid strengths of from about 5 percent up to about 40 percent are used.

The aldehydes are likewise a known class of compounds having many members. Any member of this known class can be used herein so long as it is soluble or dispersible in the aqueous acid cleaning solution and is sufficiently reactive with hydrogen sulfide produced during the cleaning process that it prevents or substantially prevents the evolution of hydrogen sulfide gas under conditions of use. A simple, relatively fast laboratory procedure will be described hereafter for evaluating aldehydes not named but which those skilled in the art may wish to utilize. Examples of suitable aldehydes include formaldehyde, paraformaldehyde, acetaldehyde, glyoxal, beta-hydroxybutyraldehyde, benzaldehyde, methyl-3-cyclohexene carboxaldehyde, and the like. Of these, formaldehyde and acetaldehyde are preferred based on economics and performance, and formaldehyde is most preferred. Commercial solutions of formalin or alcoholic solutions of formaldehyde are readily available and may be used in the present invention.

The aldehydes are included in the system in an amount to prevent or substantially prevent the evolution of hydrogen sulfide gas during the cleaning process. The amount of acid solution sulfide in the scale can be normally determined experimentally before the cleaning job is done and a stoichiometric amount of aldehyde can be determined (i.e., equimolar amounts of aldehyde and hydrogen sulfide). We prefer, however, to use excess formaldehyde. By excess, is meant amounts beyond stoichiometric required and up to one equivalent weight of aldehyde or more per equivalent weight of acid.

The aqueous acid cleaning solution may also comprise additional additives, if desired. For example, acid corrosion inhibitors (e.g., acetylenic alcohols, filming amines, etc.), surfactants, mutual solvents (such as alcohols and ethyoxylated alcohols or phenols, etc.) can be included as desired. Corrosion inhibitors usually will be required to limit acid attack upon the base metal. Amine-based corrosion inhibitors, such as those described in U.S. Pat. No. 3,077,454, are preferred.

The aqueous acid cleaning solution is normally a liquid system but can be used as a foam. We prefer to utilize liquid cleaning solutions in most instances.

The cleaning compositions used in the instant process can be formulated external to the item or vessel to be cleaned. Alternatively, the item or vessel to be cleaned can be charged with water or an aqueous solution or dispersion of the aldehyde to be used and the acid added subsequently. This technique has the advantage of permitting the operator to ascertain the circulation of liquid within the system prior to loading the active cleaning ingredient. This will therefore represent a preferred embodiment for cleaning many systems.

The temperature utilized during the cleaning process can be varied but is normally selected in the range of from ambient up to about 180° F. for the mineral acids and even up to about 225° F. for the organic acids. The upper temperature is limited only by the stability of the aldehyde and/or the ability to control acid and/or ferric ion corrosion with appropriate inhibitors. Preferred temperatures are normally in the range of from about 140° to about 160° F.

The following examples will further illustrate the invention:

EXAMPLE 1

A finely ground iron sulfide (FeS; 9.7 grams) was placed in a 250 milliliter flask fitted with a magnetic stirring bar, thermometer, and gas outlet. Water (84 ml) was added and the mixture heated to 150° F. At this point, a mixture of 47 ml 37.5% hydrochloric acid and 19.11 ml of 37% formalin (a two-fold molar excess) was added. The gas outlet port was immediately connected to a water displacement apparatus to measure the volume of any gas which was given off during the reaction. Normally, there was a temperature rise of approximately 10° F. attributable to the heat generated by the heat of diluting hydrochloric acid. This increase in temperature also accounted for a collected gas volume of approximately 1.6 ml due to expansion of gas in the system. During the four hour reaction time, 83.5% of the calculated iron available was dissolved with the final solution containing approximately 3.17 weight percent iron. There was a steady but very slight evolution of gas which in part contained hydrogen sulfide (as detected by lead acetate paper). The volume of gas generated and collected accounted for approximately 1% or less of the total hydrogen sulfide produced by this reaction. The remainder of the hydrogen sulfide generated was present essentially as trithiane, a white crystalline solid remaining in the liquid. The trithiane was identified by infrared analysis.

Substantially equivalent results were achieved using 37% formalin or paraformaldehyde in hydrochloric acid or sulfuric acid (at acid concentrations of 5%, 10%, and 15%). Likewise, substantially equivalent results were achieved using acetaldehyde or phenylacetaldehyde in 15% hydrochloric acid. The concentration of aldehyde in this system was the same as set forth above (2 molar excess) or a 4 molar excess. Little advantage was realized by going from 2 to 4 molar excess of aldehyde.

Likewise, substantially similar results were achieved using 37% formalin and 5% formic acid, 5% phosphoric acid, or a 5% acid mixture having two parts of glycolic acid for each part of formic acid. A 2 molar excess of aldehyde was used.

In other experiments, we observed that beta-hydroxybutyraldehyde, glyoxal, benzaldehyde, salicylaldehyde, acrolein, and 2-furfuraldehyde in hydrochloric acid (5% or 15%) gave good results in preventing or substantially preventing the elimination of hydrogen sulfide gas under the above experimental conditions.

Similar results were achieved when the iron sulfide in the experiment was replaced with zinc sulfide or sodium sulfide as the source of hydrogen sulfide.

EXAMPLE 2

Four iron sulfide encrusted pipe samples were cut into one inch × four inch sections and placed in a reservoir. The reservoir contained 1200 ml of 10% sulfuric acid and a two-fold stoichiometric excess (based on acid) of formaldehyde. The formaldehyde was obtained commercially as Analytical Reagent Grade 37% formaldehyde solution containing 10–15% methanol as a preservative. The acid solution also contained 0.1% by volume of a commercial corrosion inhibitor available through The Dow Chemical Company as Dowell A-196 Corrosion Inhibitor. The solution was continuously recirculated with a centrifugal pump and also heated to 150° F. (65.5° C.). During the treatment period of seven hours, the system was connected to a water displacement apparatus for measuring the quantities of gas evolved (specifically $H_2S$). There was no $H_2S$ evolved during this treatment. (Identical acid treatment without formaldehyde of similar samples produced large quantities of $H_2S$.)

After the treatment period the pipe samples were removed from the reservoir, washed with soap and water, dried and compared to similar samples which had not been cleaned. The treated samples were at least 95% free of scale. The acid solution in the reservoir was analyzed and shown to contain 16.6 grams of dissolved iron by Atomic Absorption Spectrophotometry. The solution precipitate was also analyzed and shown to contain trithiane by Infrared Spectrophotometry.

The best system known to us is an aqueous sulfuric acid cleaning solution containing formaldehyde with formaldehyde being present in excess.

We claim:

1. A method of chemically cleaning acid-soluble, sulfide-containing scale from a metal surface comprising contacting said scale with an aqueous acid cleaning composition comprising an aqueous non-oxidizing acid having at least one aldehyde dissolved or dispersed therein, which aldehyde is present in an amount at least sufficient to prevent or substantially prevent the evolution of hydrogen sulfide gas.

2. The method defined by claim 1 wherein said acid is hydrochloric acid, sulfuric acid, phosphoric acid, formic acid, glycolic acid, or citric acid.

3. The method defined by claim 2 wherein said acid is hydrochloric acid or sulfuric acid.

4. The method defined by claim 1 wherein said aldehyde is formaldehyde, paraformaldehyde, acetaldehyde, glyoxal, beta-hydroxybutyraldehyde or methyl-3-cyclohexene-carboxaldehyde.

5. The method defined by claim 1 wherein said acid is sulfuric acid and wherein said aldehyde is formaldehyde.

6. The method of claim 1 additionally comprising a compatible acid-corrosion inhibitor.

7. The method of claim 5 additionally comprising a compatible amine-based corrosion inhibitor.

8. An aqueous acid composition comprising an aqueous acid having dissolved or dispersed therein at least one aldehyde; said composition having, as one of its chemical properties, the capability of dissolving acid-soluble, sulfide-containing scale from a metal surface without the evolution of hydrogen sulfide gas, provided that the aldehyde is present in excess of the acid required to dissolve the sulfide containing scale.

9. The composition defined by claim 8 wherein said acid is hydrochloric acid, sulfuric acid, phosphoric acid, formic acid, glycolic acid, or citric acid.

10. The composition defined by claim 9 wherein said acid is hydrochloric acid or sulfuric acid.

11. The composition defined by claim 10 wherein said acid is sulfuric acid.

12. The composition defined by claim 8 wherein said aldehyde is formaldehyde or acetaldehyde.

13. The composition defined by claim 12 wherein said aldehyde is formaldehyde.

14. The composition defined by claim 11 wherein said aldehyde is formaldehyde.

15. The composition defined by claim 8 additionally comprising a compatible acid corrosion inhibitor.

16. The composition defined by claim 14 comprising a compatible amine-based corrosion inhibitor.

17. The composition defined by claim 14 wherein the concentration of said sulfuric acid is from about 5 to about 15 percent and said formaldehyde is present in excess.

18. The method defined by claim 1 wherein said aldehyde is an aliphatic aldehyde.

19. The method defined by claim 1 wherein the temperature of the aqueous acid cleaning composition is from about 140° to about 160° F.

20. The method defined by claim 5 wherein the temperature of the aqueous acid cleaning composition is from about 140° to about 160° F.

21. The method defined by claim 1 wherein said aqueous acid cleaning composition is generated in situ by adding an aqueous non-oxidizing acid to an aqueous composition having at least one aldehyde dissolved or disbursed therein which in contact with said acid-soluble sulfide-containing scale.

* * * * *